US006886486B2

(12) United States Patent
Van Rompay

(10) Patent No.: US 6,886,486 B2
(45) Date of Patent: May 3, 2005

(54) DEVICE FOR REMOVING THE GROWTH ON A SHIP'S HULL

(76) Inventor: Boudewijn Gabriël Van Rompay, 307 Spottis Woode Ct., Clearwater, FL (US) 33756

( * ) Notice: Subject to any disclaimer, the term of this patent is extended or adjusted under 35 U.S.C. 154(b) by 155 days.

(21) Appl. No.: 10/311,345

(22) PCT Filed: May 14, 2002

(86) PCT No.: PCT/BE02/00074

§ 371 (c)(1),
(2), (4) Date: Jan. 6, 2003

(87) PCT Pub. No.: WO02/096748

PCT Pub. Date: Dec. 5, 2002

(65) Prior Publication Data

US 2004/0089216 A1 May 13, 2004

(30) Foreign Application Priority Data

May 30, 2001 (BE) ..... 2001/0368

(51) Int. Cl.[7] ..... B63B 59/00
(52) U.S. Cl. ..... 114/222
(58) Field of Search ..... 114/222

(56) References Cited

U.S. PATENT DOCUMENTS

| | | | | | |
|---|---|---|---|---|---|
| 919,939 | A | * | 4/1909 | Otidys | 114/222 |
| 1,122,963 | A | * | 12/1914 | Macnicol | 114/222 |
| 1,468,646 | A | * | 9/1923 | Overall | 114/222 |
| 4,648,344 | A | * | 3/1987 | Burgers et al. | 114/222 |
| 4,690,092 | A | * | 9/1987 | Rabuse | 114/222 |
| 5,351,640 | A | * | 10/1994 | Attaway et al. | 114/222 |

* cited by examiner

*Primary Examiner*—Jesus D. Sotelo
(74) *Attorney, Agent, or Firm*—Bacon & Thomas, PLLC

(57) ABSTRACT

The invention relates to a device for removing the growth on a ship's hull (2). This device comprises a cleaning element (3) and means for displacing this cleaning element over the hull (2), which means comprise at least one cable (4) which is arranged such that it passes underneath the keel of the hull (2) and to which the cleaning element (3) and means (5) for moving the cable (4) are connected. The cleaning element comprises at least one mat (3) comprising a flat base (13) consisting of an elastically deformable material, which at least at one side, is provided with a relief (14) of wear-and-tear-resistant, elastically deformable material. In the mat (3) at least one magnet (17) is provided.

10 Claims, 2 Drawing Sheets

DEVICE FOR REMOVING THE GROWTH ON A SHIP'S HULL

This invention relates to a device for removing the growth on the steel hull of a ship, which device comprises a cleaning element and means for moving this cleaning element over the hull, which means comprise at least one cable which is arranged such that it passes underneath the keel of the hull and to which the cleaning element and the means for moving the cable are connected.

On the hull of a ship, in particular a sea ship, more particularly, on the part situated under water, algae and other organisms are growing, and in particular sea pocks and barnacles or other crustaceae, as a consequence of which the ship experiences a larger resistance in the water during moving, such that this growth has to be removed from time to time.

This removal may be performed by divers, however, this is time-consuming and expensive.

Therefore, devices have been designed for the mechanical removal thereof.

Such device is described in the Belgian patent No. 901.110.

This device consists of a carrier frame and means for moving this carrier frame with one or two cables alongside the hull of the ship. In the carrier frame, a pivotable frame is provided on which brushes are mounted.

This device has a rather complicated construction and is expensive. Moreover, the brushes are not always in contact with the ship's hull, so that the cleaning is not very efficient.

Non-rotating brushes are not able to remove, amongst others, sea pocks and barnacles.

Thus, the present invention has as an object a device for removing the growth on a ship's hull, which is constructively very simple and relatively inexpensive, however, allows an efficient cleaning and thus also allows to remove sea pocks and barnacles.

According to the invention, this aim is achieved in that the cleaning element comprises at least one mat which comprises a flat base consisting of an elastically deformable material, in particular rubber or a rubber-like material, which, at least at one side, is provided with a relief of a wear-and-tear-resistant, elastically deformable material, preferably the same as the remainder of the mat, in or on which mat at least one magnet is provided for pushing it against the ship's hull.

This mat is of a simple construction and does not comprise any moving parts.

The relief may consist of ribs, nubs or protrusions with hollow parts.

At the location of an interruption of the cable, the mat can interconnect parts of this latter. The cable may also extend continuously, the mat being attached thereto.

The means for displacing the cable preferably are means which can displace this cable as such, as well as displace the part of this cable situated along the ship's hull in the longitudinal direction of this hull.

To this aim, these means may comprise two winches which can be displaced in the longitudinal direction of the hull and in between which the cable is provided.

If another strip-shaped part in longitudinal direction of the ship must be cleaned, the winches have to be displaced.

In another form of embodiment, the means for displacing the cable comprise two stationary winches and two guide means which can be displaced in the longitudinal direction of the hull, whereby the cable extends from one winch over guide means at the one side of the hull, passing underneath the keel of the hull, and over guide means at the other side to the other winch.

With the intention of better showing the characteristics of the invention, hereafter, as an example without any limitative character, two preferred forms of embodiment of a device for removing the growth on a ship's hull according to the invention are described, with reference to the accompanying drawings, wherein:

FIG. 1 schematically represents a side view of a ship on which a device for removing the growth on a ship's hull according to the invention is provided;

FIG. 2 schematically represents a plan view of the ship from FIG. 1;

FIG. 3 represents a plan view, similar to that of FIG. 2, however, relating to another form of embodiment of the device according to the invention;

FIG. 4, at a larger scale, represents a front view of a mat from the device according to the invention;

Figure 1:
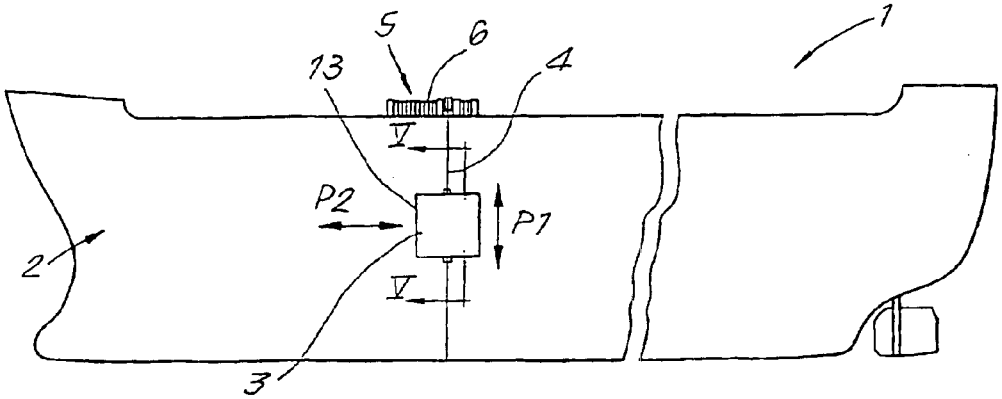
Figure 2:
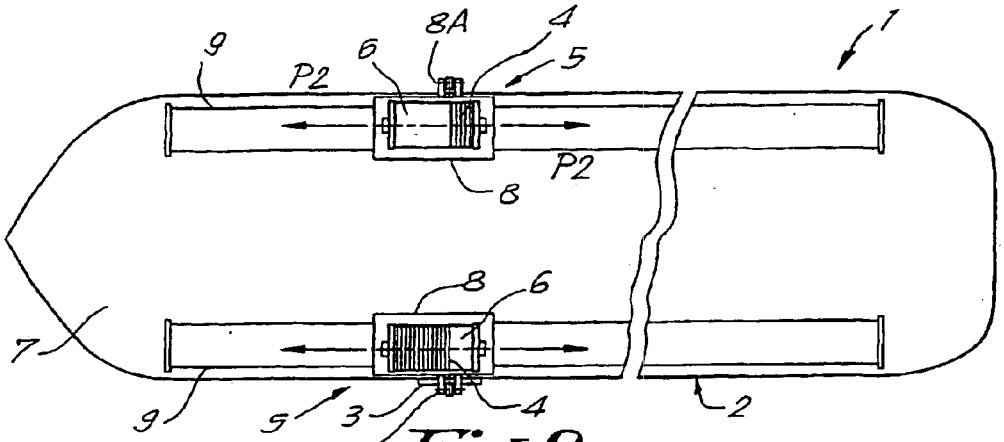
Figure 3:
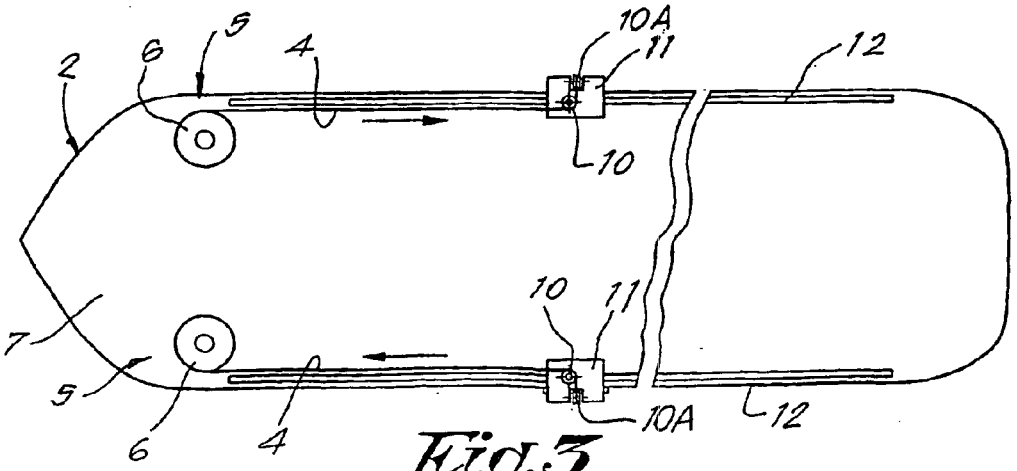

In FIGS. 1 to 3, a sea ship 1 is represented, whereby the growth on its steel hull 2 is removed by means of a device according to the invention, which substantially consists of a mat 3 and means for displacing this mat 3 over the hull 2.

These means for displacing the mat 3 consist of a cable 4 which is provided from deck to deck, passing underneath the keel, and to which the mat 3 is attached, and of means 5 for displacing this cable 4 as such as well as to displace it with its portion situated along the hull 2 in the longitudinal direction of the hull 2.

In the form of embodiment represented in FIGS. 1 and 2, the means 5 for displacing the cable 4 consist of two winches 6 which are arranged at starboard, port, respectively, on the deck 7 and to which the extremities of the cable 4 are attached.

These winches 6 can be synchronized such that, when one winch 6 is winding the cable 4 on its drum, the other winch 6 unwinds the cable 4 from its drum to the same extent.

As a consequence thereof, the cable 4 as such is displaceable, as a result of which the mat 3 can be displaced up and down along the hull 2, such as represented in FIG. 1 by arrows P1.

In order to displace the part of the cable 4 which is situated along the hull 2, as well as the mat 3 in the longitudinal direction of the hull 2, as represented by arrows P2, the two winches 6 are arranged on carriages 8 which can be moved over guides 9 which are provided over the length of the deck 7.

On each carriage 8, additional cable guides 8A, for example, horizontal rolls, can be provided for guiding the cable 4 into the water when it is unwound from or wound onto the winch's drum.

In the form of embodiment represented in FIG. 3, the means for displacing the mat 3 also comprise two winches 6, however, those are fixedly arranged at one extremity of the deck 7.

However, the means comprise two guide means 10–10A, at port, starboard, respectively, which can be displaced in the longitudinal direction of the ship, which guide means alter the direction of the cable 4, which means, in the represented example, each comprise a wheel 10, rotatable around a vertical axis, possibly followed by a horizontal guide or roll 10A, which are provided on carriages 11 which can be displaced over guides 12.

The cable 4, coming out of the water, alters its direction at opposite sides of the ship 1, over the guide means 10–10A, before being connected to a winch 6.

In order to displace the part of the cable 4 situated along the ship's hull 2 in the longitudinal direction of the hull 2, the two carriages 11 with the guide means 10–10A have to be displaced simultaneously, in the same direction.

The carriages 11 and the guides 12 do not have to be realized as heavy as in the above-described form of embodiment, on account of the fact that they do not have to carry heavy winches 6.

As represented in detail in FIGS. 4 to 9, the mat 3 substantially consists of a supple and elastically deformable flat base 13, which, at the front side with which it is directed towards the hull 2, is provided with a relief 14 which also is elastically deformable.

The base 13 and the relief 14 are manufactured of the same material, although it is not excluded that in variants, the base 13 and the relief 14 are manufactured of different, but still elastically deformable materials.

Even if they are manufactured of the same material, due to the applied manufacturing techniques, the physical properties of the base 13 and the relief 14 may differ. So, the density of the relief may be higher than that of the base 13, such that the relief 14 in fact is elastically deformable, however, still is harder and more rigid than the base 13.

The aforementioned material is, for example, rubber, natural as well as synthetic rubber, such as neoprene or butyle rubber. In variants, the material of the base 13 and/or the relief 14 may be another rubber-like material or a wear-and-tear-resistant supple synthetic material, such as nylon.

At its rear side turned away from the hull 2, the base 13 is provided with protruding edges 15, and in the hollow part 16 situated between these edges 15, a number of magnets 17 are attached to the base 13, which magnets provide for that the mat 3, during the displacement thereof over the steel hull 2, is retained against this latter.

The base 13 is oblong and, for example, rectangular. At both extremities, this base 13 is fixed to the continuing cable 4 by means of clamps 18.

The relief 14 may take a variety of forms.

Figure 5:
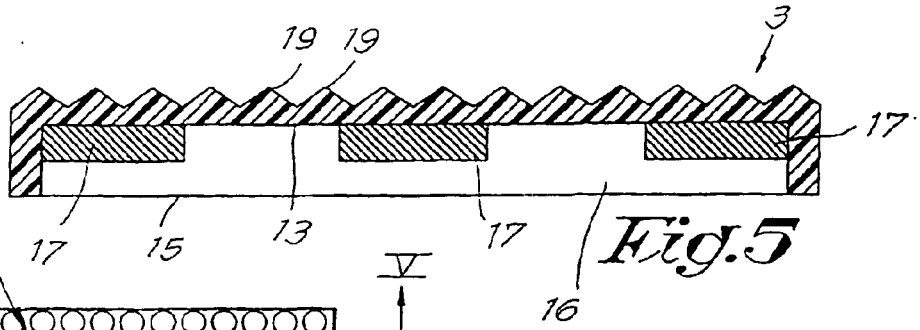
FIG. 5 represents a cross-section according to line V—V in FIG. 4, drawn to a larger scale.
Figure 4:
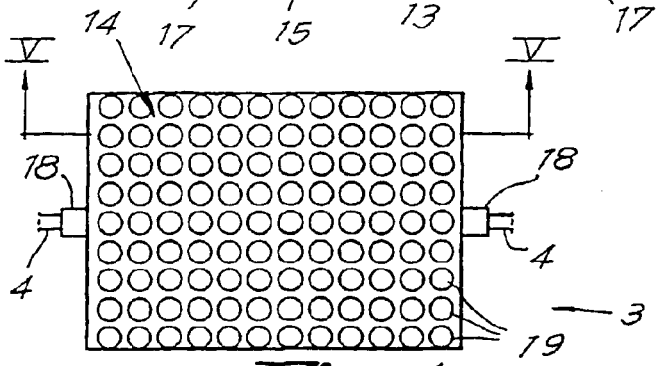

In the form of embodiment represented in FIGS. 4 and 5, the relief 14 is formed by conical nubs 19.

Figure 6:
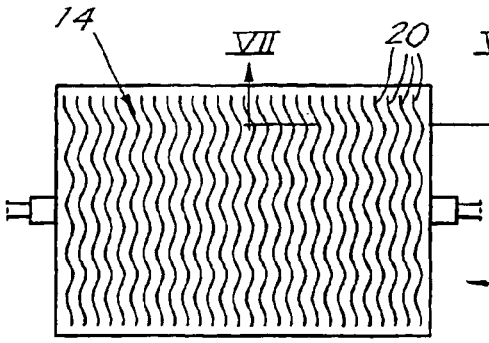
FIG. 6 represents a front view of a mat analogous to that of FIG. 4, however, relating to another form of embodiment of the invention.
Figure 7:
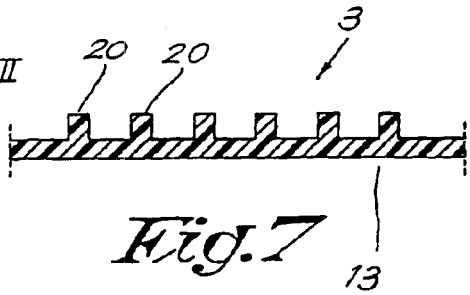
FIG. 7 represents a cross-section according to the line VII—VII in FIG. 6, drawn to a larger scale.

The form of embodiment represented in FIGS. 6 and 7 differs from the form of embodiment according to FIGS. 4 and 5 in that the relief 14 is formed by wavy ribs 20.

Figure 8:
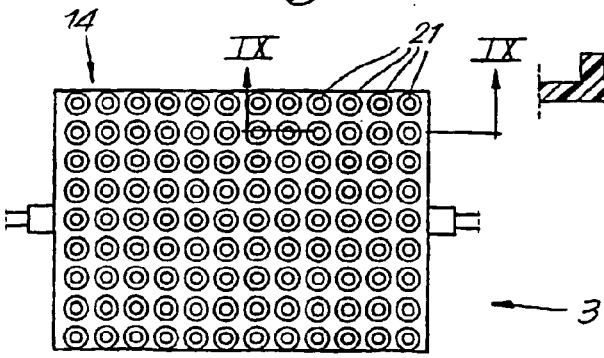
FIG. 8 represents a front view, analogous to that of FIGS. 4 and 6, however, relating to still another form of embodiment of the mat.
Figure 9:
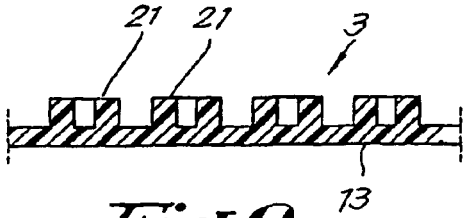
FIG. 9 represents a cross-section according to line IX—IX in FIG. 8, drawn to a larger scale.

Finally, in the form of embodiment represented in FIGS. 8 and 9, the relief 14 is formed by cylindrical or prismatic protrusions 21 which in the middle are provided with an opening or hollow part.

The functioning of the device according to the invention is very simple and as follows.

By means of the winches 6, the cable 4 is moved to and fro, as a result of which the mat 3 connected thereto also is moved up and down according to arrows P1 and thereby removes the growth.

Also by the magnets 17, the mat 3 thereby is pushed against the metal hull 2 of the ship. As said mat is elastically deformable, it hereby adapts to shape alterations or unevennesses of this hull 2.

Due to the special relief 14 consisting of a wear-and-tear-resistant material, an optimum removal of the growth, including sea pocks and barnacles, is ensured.

When, after the mat 3 has been repeatedly moved in the aforementioned manner from port to starboard and back, a certain strip-shaped part of the hull 2 has been cleaned, then in the form of embodiment according to FIGS. 1 and 2 both winches 6 are driven further about the width of said part, after which the cable 4 again is moved to and fro by the winches 6 and the mat 3 cleans another strip-shaped part of the hull 2.

In the form of embodiment according to FIG. 3, not the winches 6, but only the guides 12 are displaced. Hereby, the cable 0.4 of course must be wound upon both winches 6 or unwound therefrom for a short length. After the displacement, the cable 4 further is drawn to and fro around the keel, and another strip-shaped part is cleaned by the mat 3.

The cable 4 must not necessarily be interrupted at the location of the mat 3. It may also extend continuously.

At the mat 3, also two or more cables 4 may be attached next to each other.

The present invention is in no way limited to the forms of embodiment described as an example and represented in the figures, on the contrary may such device for cleaning ships' hulls be realized in different forms and dimensions, without leaving the scope of the invention.

What is claimed is:

1. Device for removing the growth on the steel hull (2) of a ship, which device comprises a cleaning element (3) and means for displacing this cleaning element over the hull (2), which means comprise at least one cable (4) which is arranged such that it passes underneath the keel of the hull (2) and to which the cleaning element (3) and means (5) for moving the cable (4) are connected, characterized in that the cleaning element comprises at least one mat (3) comprising a flat base (13) consisting of an elastically deformable material, which, at least at one side, is provided with a relief (14) of wear-and-tear-resistant, elastically deformable material, in or on which mat (3) at least one magnet (17) is provided for pushing this mat (3) against the ship's hull (2).

2. Device according to claim 1, characterized in that the relief (14) is manufactured of the same material as the remainder of the mat (3).

3. Device according to claim 1, characterized in that the relief (14) is manufactured of rubber or a rubber-like material.

4. Device according to claim 1, characterized in that the relief consists of ribs (20).

5. Device according to claim 1, characterized in that the relief consists of nubs (19).

6. Device according to claim 1, characterized in that the relief consists of protrusions (21) with hollow parts.

7. Device according to claim 1, characterized in that the mat (3) is situated at the location of an interruption of the cable (4) and interconnects parts of the cable (4).

8. Device according to claim 1, characterized in that the means (5) for displacing the cable (4) are means which can displace this cable (4) as such, as well as means which can displace the portion of the cable (4) situated along the ship's hull (2) in the longitudinal direction of this hull (2).

9. Device according to claim 8, characterized in that the means (5) for displacing the cable (4) comprise two winches (6) which can be moved in the longitudinal direction of the hull (2) and in between which the cable (4) is provided.

10. Device according to claim 8, characterized in that the means (5) for displacing the cable (4) comprise two stationary winches (6) and at least two guide means (1010A) which can be displaced in the longitudinal direction of the hull (2), whereby the cable (4) extending from one winch (6) runs from the first guide (10), underneath the keel of the hull (2), over a second guide (10) to the other winch (6).

* * * * *